United States Patent [19]

Tortorello

[11] 3,934,300

[45] Jan. 27, 1976

[54] DRINKING GLASS CLEANER

[75] Inventor: Albert Tortorello, Mountainside, N.J.

[73] Assignee: The Raymond Lee Organization, Inc., New York, N.Y. ; a part interest

[22] Filed: Apr. 15, 1974

[21] Appl. No.: 460,970

[52] U.S. Cl. ..... 15/244 R; 15/211

[51] Int. Cl.[2] ..... A47L 17/10; B08B 9/00

[58] Field of Search..... 15/164, 165, 210 A, 210 B, 15/211–213, 214, 218, 218.1, 244 R, 244 CH; 401/9, 10

[56] References Cited

UNITED STATES PATENTS

| | | | |
|---|---|---|---|
| 1,759,788 | 5/1930 | Holveck | 15/210 B |
| 2,856,625 | 10/1958 | Delacretaz | 15/210 A X |
| 3,063,083 | 11/1962 | Obitts | 15/2.4 X |
| 3,205,527 | 9/1965 | Laird | 15/244 R |
| 3,230,563 | 1/1966 | Swanson | 15/164 |

FOREIGN PATENTS OR APPLICATIONS

| | | | |
|---|---|---|---|
| 626,404 | 7/1949 | United Kingdom | 15/210 A |
| 1,439,144 | 4/1966 | France | 15/210 B |
| 148,057 | 2/1904 | Germany | 15/218.1 |
| 984,282 | 2/1951 | France | 15/218.1 |
| 8,458 | 5/1900 | United Kingdom | 15/214 |
| 1,088,352 | 9/1954 | France | 15/164 |

*Primary Examiner*—Daniel Blum
*Attorney, Agent, or Firm*—Howard I. Podell

[57] ABSTRACT

A glass cleaner in the form of a pair of tongs having free end flanges bent at right angles with a section of sponge material on the inner surface of each tong and its flange. The flanges are of different lengths for the cleaning of drinking glasses of different diameters.

1 Claim, 4 Drawing Figures

DRINKING GLASS CLEANER

SUMMARY OF THE INVENTION

My invention relates to a drinking glass cleaner and particularly to a device in the form of a pair of tongs, with a section of a flexible sponge material, such as foam rubber or polyurethane foam, fixed on the inner surface of each tong. The end of each tong is bent at right angles to the tong so as to clean the bottom of a glass, when the tongs grip and clean the inner and outer sides of the glass. The device may be held by hand, or fitted on a mounting base in use.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
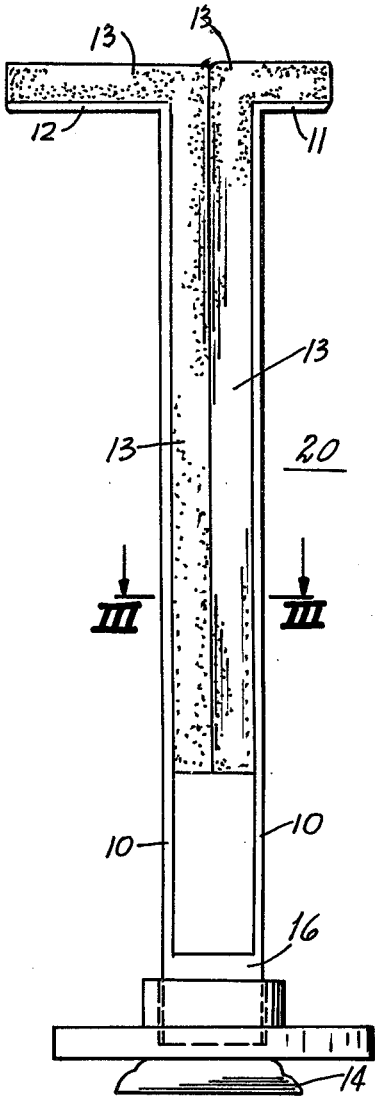
FIG. 1 is an elevation view of the glass cleaner and mounting base.

Turning now descriptively to the drawings, in which similar reference characters denote similar elements throughout the several views, FIG. 1 illustrates the glass cleaner device 20 consisting of a pair of joined tongs 10 of rectangular sectional shape, the ends 11 and 12 of each tong 10 being bent at right angles to the length of the tong to form flanges. A liner 13 of flexible and absorbent material is fastened to the interior surface of each tong, with the liner 13 projecting about the tong ends 11 and 12. A mounting base 14 fastened to the common section 16 of the device 20 is fitted at its end with a suction cup 14 or with other means, such as adhesive, to fasten the device to a flat surface of a counter top. Alternately, as shown in FIG. 2, the device

30 may be in the form of a handheld tool, without attachment means to a base.

Figure 2:
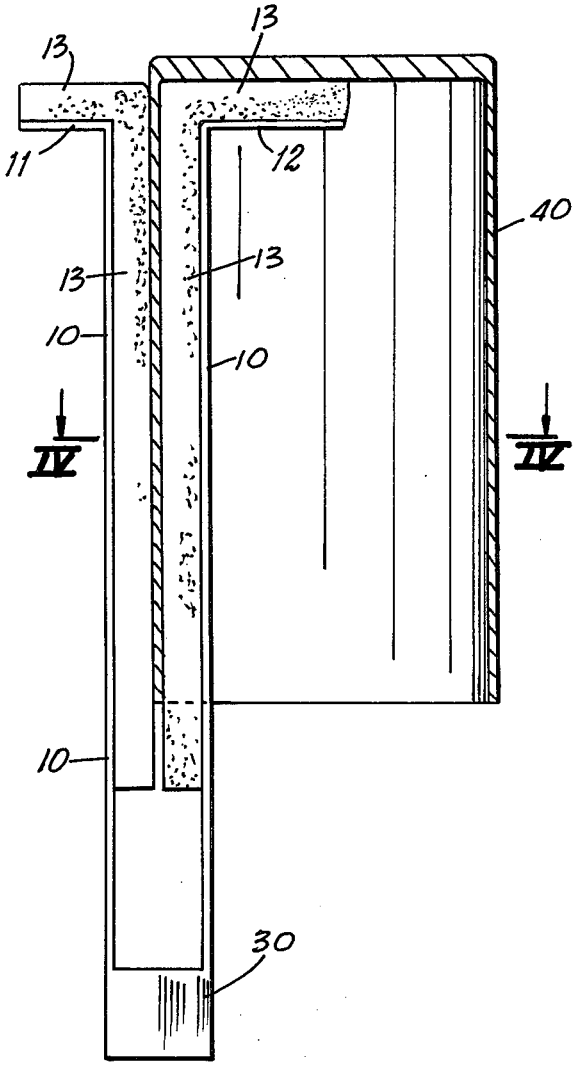
FIG. 2 is an elevation view of an alternate embodiment of the device in use.

In use, as shown in FIG. 2 a glass 40, dipped in a dishwashing solution is inserted between the interior sponges 13 of the tong members 10 so as to press against the bottom interior and side surfaces of the glass, and the glass is rotated, with the sponges 13 acting to wipe the glass clean. The different lengths of flanges 11, 12 are for cleaning glasses of different diameters.

Figure 3:
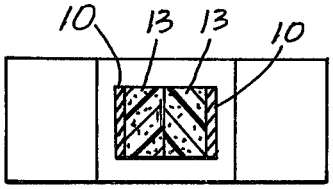
FIG. 3 is a sectional view taken along line 3—3 of FIG. 1.
Figure 4:
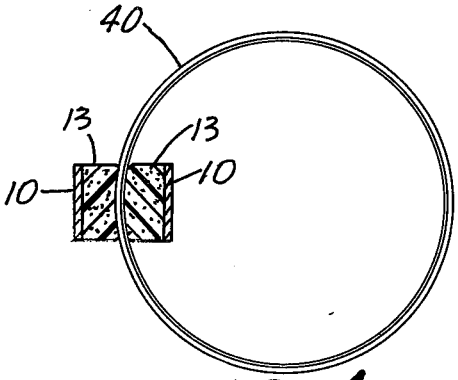
FIG. 4 is a sectional view taken along line 4—4 of FIG. 2.

As shown in FIG. 3, the sponges 13 may be of rectangular cross-section, or the sponges may be shaped to conform to the concave and convex shape of the walls of a drinking glass.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device for cleaning the inside and outside surfaces of a cylindrical drinking glass is comprising a pair of tong members having parallel intermediate sections flexibly joined together at one end so that they may be moved to or away from each other with a section of absorbent sponge material fastened to each of the adjacent surfaces of each tong member, in which the free end of each tong member is bent at right angles away from the intermediate section of the tong member with the absorbent sponge material fastened along the length of the intermediate section and the said bent end of each tong member to form a shaped absorbent sponge surface generally parallel to the planes of the attached intermediate section and the bent end of the tong member and means on the joined portion to fasten the device to a flat surface, the bent end section of each tong member and its respective sponge material being of different lengths so that each tong member is suitable for cleaning the inside wall and inside bottom surface of a drinking glass of a different internal diameter.

* * * * *